US010900325B2

(12) United States Patent
López Robayo

(10) Patent No.: US 10,900,325 B2
(45) Date of Patent: Jan. 26, 2021

(54) CASING FOR THE CIRCULATION OF FLUIDS AT THE BOTTOM OF A WELL, WITH A DOWNWARD-FACING OPENING, FOR OIL WELLS

(71) Applicant: Sertecpet S.A., Quito (EC)

(72) Inventor: Byron Raúl López Robayo, Quito (EC)

(73) Assignee: SERTECPET S.A., Quito (EC)

( * ) Notice: Subject to any disclaimer, the term of this patent is extended or adjusted under 35 U.S.C. 154(b) by 115 days.

(21) Appl. No.: 15/744,587

(22) PCT Filed: Jul. 9, 2016

(86) PCT No.: PCT/IB2016/054129
§ 371 (c)(1),
(2) Date: Jan. 12, 2018

(87) PCT Pub. No.: WO2017/009765
PCT Pub. Date: Jan. 19, 2017

(65) Prior Publication Data

US 2018/0195367 A1 Jul. 12, 2018

(30) Foreign Application Priority Data

Jul. 14, 2015 (EC) ..... IEPI-2015-30311

(51) Int. Cl.
*E21B 34/12* (2006.01)
*E21B 34/14* (2006.01)
(Continued)

(52) U.S. Cl.
CPC ..... *E21B 34/12* (2013.01); *E21B 34/14* (2013.01); *E21B 2200/06* (2020.05)

(58) Field of Classification Search
CPC ..... E21B 34/12; E21B 34/14; E21B 34/007; E21B 23/00; E21B 33/14; E21B 37/08
See application file for complete search history.

(56) References Cited

U.S. PATENT DOCUMENTS 4,695,197 A * 9/1987 Watt ..... E02B 3/16 114/296
5,316,084 A * 5/1994 Murray ..... E21B 33/1208 166/332.4
(Continued)

FOREIGN PATENT DOCUMENTS

CN 200982181 Y 11/2007
CN 102261231 A 11/2011
(Continued)

OTHER PUBLICATIONS

International Search Report, PCT Application No. PCT/IB2016/054129, dated Nov. 11, 2016.

*Primary Examiner* — Tara Schimpf
*Assistant Examiner* — Manuel C Portocarrero
(74) *Attorney, Agent, or Firm* — Kilpatrick Townsend & Stockton LLP

(57) ABSTRACT

Casings for the circulation of fluids, used at the bottom of oil wells, applicable in conventional systems for bottom completion in the oil industry are provided. Specifically, modification of the design of the casing in the form of the opening thereof, which is carried out by moving the sliding sleeve downwards, the aim of which is to solve the problem of the accidental closing of the casing as a jet pump enters same.

4 Claims, 8 Drawing Sheets

(51) Int. Cl.
*E21B 23/00* (2006.01)
*E21B 37/08* (2006.01)

(56) References Cited

U.S. PATENT DOCUMENTS

| | | | | |
|---|---|---|---|---|
| 5,479,991 | A * | 1/1996 | Robison | E21B 33/12 166/133 |
| 5,678,633 | A | 10/1997 | Constantine, Jr. | |
| 6,722,439 | B2 | 4/2004 | Garay et al. | |
| 2003/0037932 | A1* | 2/2003 | Guillory | E21B 23/06 166/387 |
| 2014/0332228 | A1* | 11/2014 | Antonsen | E21B 34/14 166/373 |

FOREIGN PATENT DOCUMENTS

| | | | |
|---|---|---|---|
| CN | 203978383 | U | 12/2014 |
| EP | 0399890 | A1 | 11/1990 |

* cited by examiner

CASING FOR THE CIRCULATION OF FLUIDS AT THE BOTTOM OF A WELL, WITH A DOWNWARD-FACING OPENING, FOR OIL WELLS

DETAILED DESCRIPTION

Field and Purpose of the Invention

This invention relates to casings for the circulation of fluids, used at the bottom of oil wells and applicable in conventional systems for bottom completion in the oil industry. Specifically, it consists of the modification of the design of the casing in the form of its opening, which is carried out by moving the sliding sleeve downwards, the aim of which is to solve the problem of the accidental closing of the casing at the moment a jet pump enters the same.

Prior Art

For controlling an oil well during intervention processes, fluids are circulated through the casing or circulation valve for reconditioning, or for equalizing any pressures existing between the pipe and the annular space as well. Additionally, this casing serves to house a jet pump to pump oil, with the risk in this specific case that the casing accidentally closes for various reasons, such as: at the moment the pump is introduced; due to its moving; or because of accumulation of material such as mud or sand from the well entering the casing. This closing interrupts the flow pumped outwards.

In prior art, there are some solutions to this problem, such as:

U.S. Pat. No. 5,678,633A dated Oct. 21, 1978, entitled "SLIDING TOOL", which refers to a sliding tool which is, preferably, hydraulically operated. An accumulated hydraulic force overcomes a retaining piston, which, in turn, releases a pivoting joint with a movement opposed by a coil spring. The coil spring forces the pivoting joint to open where a contact can be established with the internal slot on a sliding sleeve. The sliding tool may be driven with the joint in the expanded position, since the parts are configured to allow the joint to be retracted in order to clear any internal obstructions before reaching the slots in the sliding sleeve. The pivoting action of the handle in the slot in the sliding sleeve increases the grip force when obstacles appear. The parts are configured so that there is minimum movement of the moving parts, which have seals to further reduce any potential wear on the pressure seals. A compact design is provided, which may be useful in the sleeves with a series of internal perforations. The coil springs used in the preferred embodiment, which act against the linkage, can be easily replaced to adjust the coupling force with the internal slot in the shifting sleeve. That is, this solution provides an articulated means to open and close the casing, ensuring its opening and closing by means other than those proposed in this invention.

U.S. Pat. No. 6,722,439B2 dated Apr. 20, 2004, entitled "MULTIPOSITION SLIDING SLEEVE VALVE", refers to a downhole choke in the form of a sleeve valve which may be operated in a plurality of positions, including fully open, fully closed, and intermediate positions. It has an hydraulic control system which, in one embodiment, provides the driving force to move the sliding sleeve to a certain extent for a given control pressure applied. Other increases in applied pressure result in other predetermined movements of the sliding sleeve. In another embodiment, the sliding sleeves are coupled in a series of slots in the surrounding housing depending on the degree of pressure applied to the control system. That is, this solution provides a means of hydraulic control to ensure the opening and closing of the casing by means other than those proposed in this invention.

In the cases mentioned from prior art, it can be seen that the proposed solutions for the control of the opening and closing of the casing depend on an external control, which may be hydraulic or jointed, to avoid the accidental closing of the casing caused by an unwanted movement of the sleeve to its closed position as the jet pump enters, which may occur due to any wear of the casing or to the presence of solid residues or sediments favoring the drifting of the sleeve. These situations existing in prior art cause high additional costs, which is reflected in production and operation: therefore, in this invention, in order to solve this problem, important modifications have been developed in the design of the conventional circulation casing, so that the same standard tool can be used in the circulation casing opening and closing operations, without any need to use other pressure forces, such as hydraulics or jointed, thus avoiding accidental closing and the subsequent interruption of production.

BRIEF DESCRIPTION OF THE INVENTION

In order to solve this problem, the casing for the circulation of fluids at the bottom of oil wells has been modified, and a new design thereof, which differs from prior art in that the opening of the casing is carried out by moving the sliding sleeve downwards, is proposed. Therefore, it is observed that the new design eliminates the risk that the circulation casing closes as the jet pump enters, a problem that is caused, among other circumstances, by the presence of solids or solid contaminants that are present in the fluids of the well, or by wear of the circulation sleeve, obtaining as a result a safe casing for the circulation of fluids at the bottom of oil wells, which guarantees its opening at the moment of operation of the pump.

The casing for the circulation of fluids at the bottom of oil wells of this invention incorporates the following essential and innovative changes in its design:

1. A different sliding sleeve (device for opening and closing the casing), which has been positioned in an inverted manner, in comparison with a conventional circulation casing. In this new design, the sliding sleeve does not have the set of vulcanized seals in its external peripheral part, as in prior art, but rather the vulcanized seals are housed in the internal part of the casing body for greater security, thus preventing their damage by the flowing of fluids.
2. The threaded connections of the casing body have been modified according to the type of thread that each of the connectors has, both in the upper part and in the lower part.
3. The outer diameter of the circulation casing body has been increased by 1.27 cm (500 thousandths of an inch) to guarantee greater tensile strength, compression and stress management for operations in the well. In its inner part, it houses the sealing elements that are attached to the latch casing
4. The diameter of the tubular cylindrical adapters have also been increased to ensure greater tensile strength and also to maintain the same diameter along the entire circulation casing. For the reasons stated in the previous section, it was necessary to mechanically redesign all parts of the casing, since inside the well, when there is a pack-off, we proceed to make downward and upward movements trying to free the tools, which exposes them to dangerous stress.

DETAILED DESCRIPTION OF THE INVENTION

Figure 1:
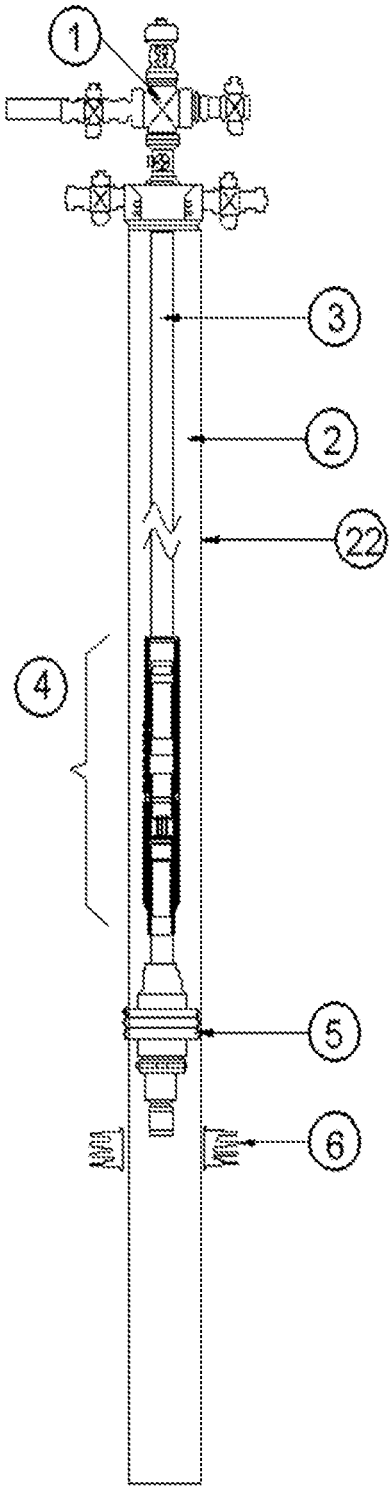
FIG. 1 represents a schematic view of the mechanical completion of a model oil well; the following parts are specified: a wellhead [FIG. 1(1)]; the production pipe [FIG. 1(3)], which is connected to the head at one end and to the circulation casing at the other [FIG. 1(4)]; the annular space [FIG. 1(2)]; the coating pipe [FIG. 1(22)]; the packer [FIG. 1(5)]; and the exit towards the formation at the bottom of the well [FIG. 1(6)].
Figure 4:
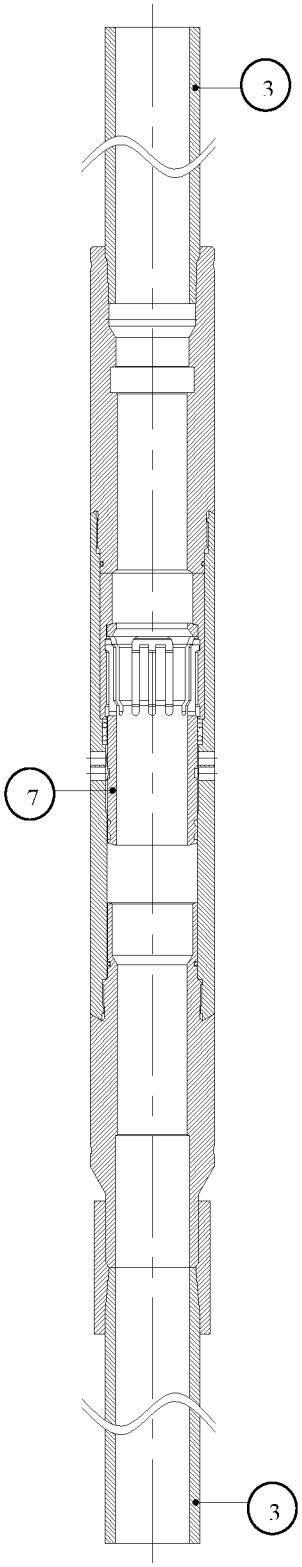
FIG. 4 represents a cross-sectional view of the circulation casing [FIG. 1(4)] coupled to the production pipe [FIG. 4(3)] by its upper and lower ends. The following elements are also specified: sliding sleeve [FIG. 4(7)].
Figure 5A:
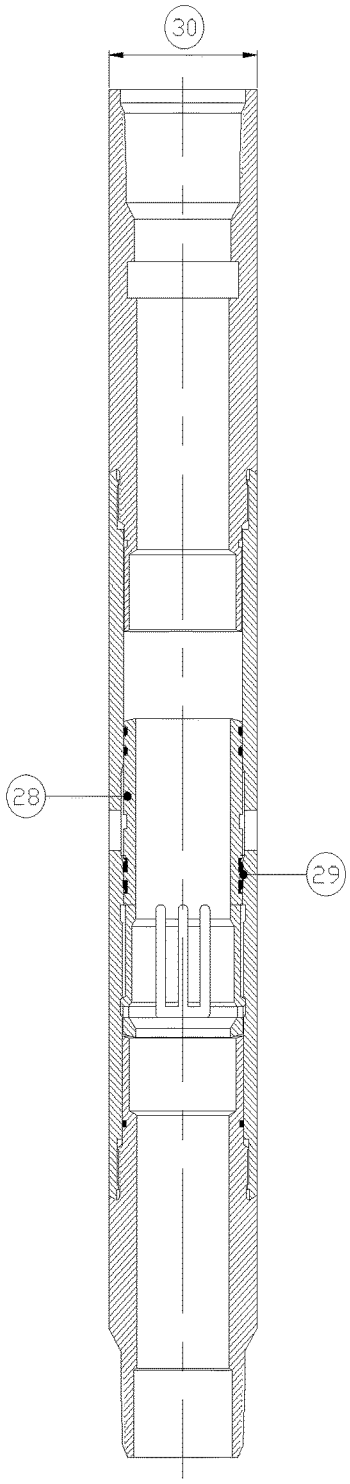
FIGURE 5A (Prior Art)
FIG. 5*a* represents a longitudinal cross-sectional view of the conventional casing.
Figure 5B:
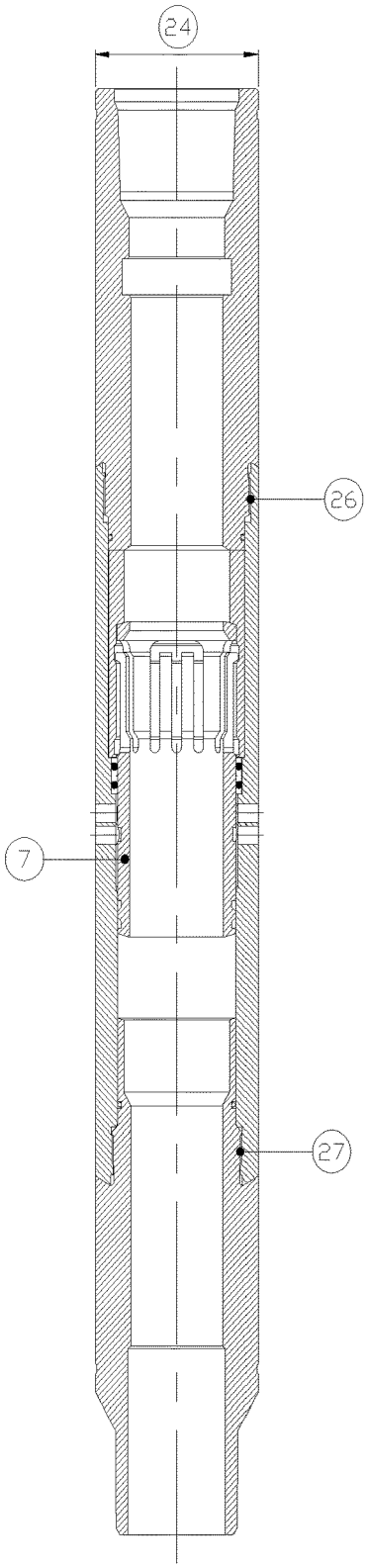
FIG. 5*b* represents a longitudinal cross-section view of the new casing for the circulation of fluids for oil wells under this invention, evidencing the new design of its parts, such as its larger diameter [FIG. 5*b* (24)] in comparison with the previous one [FIG. 5*a* (30)], thus ensuring greater tensile strength and compression for the tasks of the completion process, which is when these elements are exposed to extreme stress; for example, if there is a pack-off in the casing, when it is retrieved to the surface. They also show the main differences between the previous closing sleeve [FIG. 5*a* (28)], which has the vulcanized seals, and the new one [FIG. 5*b* (7)], which no longer has vulcanized seals in the sleeve body; this eliminates the existing possibility in the design of prior art that the seals are damaged by the flowing of high pressure fluids.
Figure 6A:
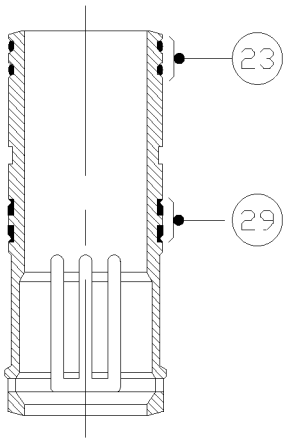
FIGURE 6A (Prior Art)
FIG. 6*a* represents the conventional sliding sleeve, which has vulcanized seals attached to its body.
Figure 6B:
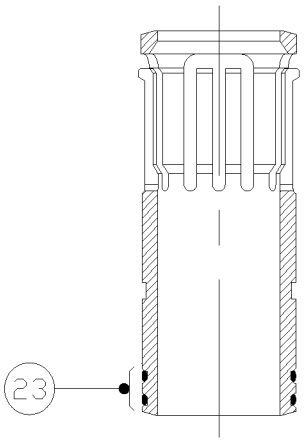
FIG. 6*b* represents the redesigned sliding sleeve that is part of the new circulation casing; this sleeve does not have vulcanized seals, which makes it permanently reusable and thus increases the useful life of the equipment.

The circulation casing [FIG. 1(4)] controls the flow of a fluid both in production and in well tests. This casing has threaded connections in its upper and lower parts to the production pipe [FIG. 4(3)] and may house jet-type hydraulic pumps for artificial lifting and a sliding sleeve [FIG. 2A(7)] that opens or closes the circulation casing windows [FIG. 2A(12)] to allow or block the flow of production fluid from the pipe to the annular space or vice versa; the number of casings installed on completion of the well will depend on the number of producing formations.

Figure 2A:
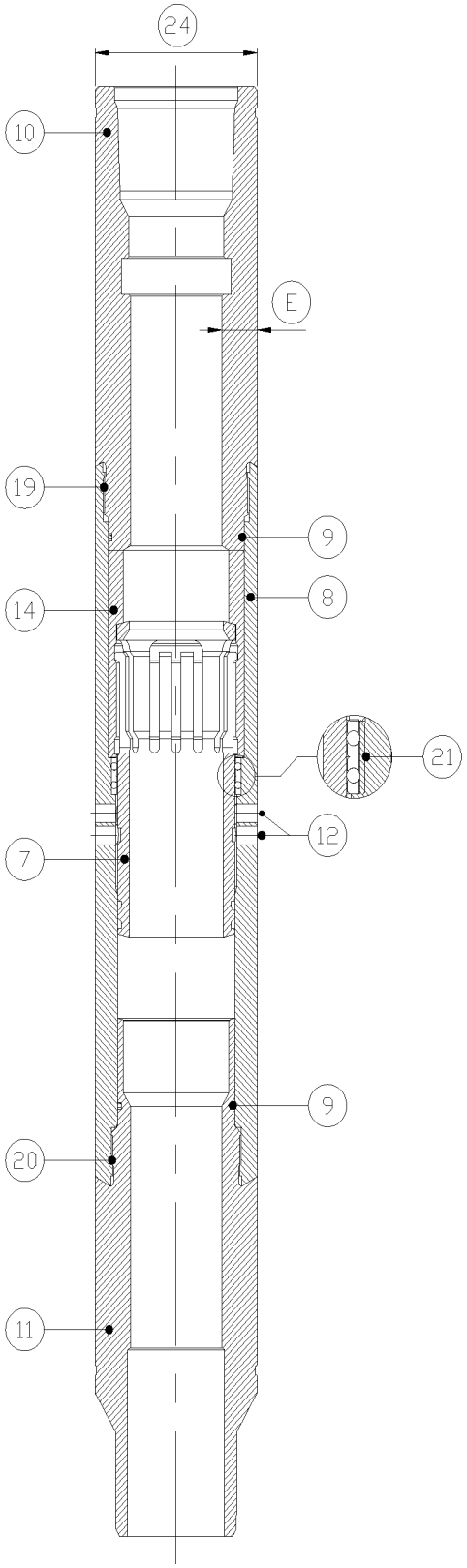
FIG. 2A represents a cross-sectional view of the circulation casing assembly according to this invention and specifies the following parts: the sliding sleeve in an inverted position [FIG. 2A(7)]; the redesigned tubular cylindrical housing [FIG. 2A (8)]; "O" rings [FIG. 2A(9)]; an upper cylindrical adapter [FIG. 2A(10); a lower cylindrical adapter [FIG. 2A(11)]; the peripheral circulation windows [FIG. 2A(12)]; the seal retaining sleeve [FIG. 2A(14)]; a threaded connection for the upper adapter [FIG. 2A(19)] in the tubular cylindrical housing for its coupling with the upper cylindrical adapter, a threaded connection for the lower adapter [FIG. 2A(20)] in the tubular cylindrical housing for its coupling with the lower cylindrical adapter, a threaded connection for the lower adapter; a set of seals [FIG. 2A(21)]. The following elements are also highlighted: the increased diameter of the sleeve [FIG. 2A(24)], due to its increase in thickness [FIG. 2A(E)] by 1.27 cm.

FIG. 2A shows a longitudinal axial section view of the assembly of the circulation casing [FIG. 1(4)] and the sliding sleeve in the inverted position [FIG. 2A(7)]. The circulation casing is formed by a tubular cylindrical housing of an adequate design for the inverted position of the sleeve [FIG. 2A(8)], which has ends threaded to the upper connector [FIG. 2A(10) and the lower connector [FIG. 2A(11)], and uses an "O" ring [FIG. 2A(9)] for sealing these connections; the upper [FIG. 2A(10) and lower connectors [FIG. 2A(11)] are threaded as well to the production pipe [FIG. 1(3)]. The tubular cylindrical housing [FIG. 2A(8)] has in its peripheral wall a series of perforations or windows [FIG. 2A(12)]. On the inner wall of the housing, in its lower part, there is a polished surface where the sliding sleeve is housed [FIG. 2A(7)]. In the upper part of the housing, next to the peripheral circulation windows, there is a space where the set of seals is housed [FIG. 2A(21)], followed by the seal retaining sleeve [FIG. 2A(14)], which has two slots on its internal wall that serve as safety housings [FIG. 3(13*a*)] and [FIG. 3(13*b*)] are axially separated, and in which the circumferential latch hooks [FIG. 3(15)] are locked according to the position of the sliding sleeve [FIG. 2A(7)].

Figure 2B:
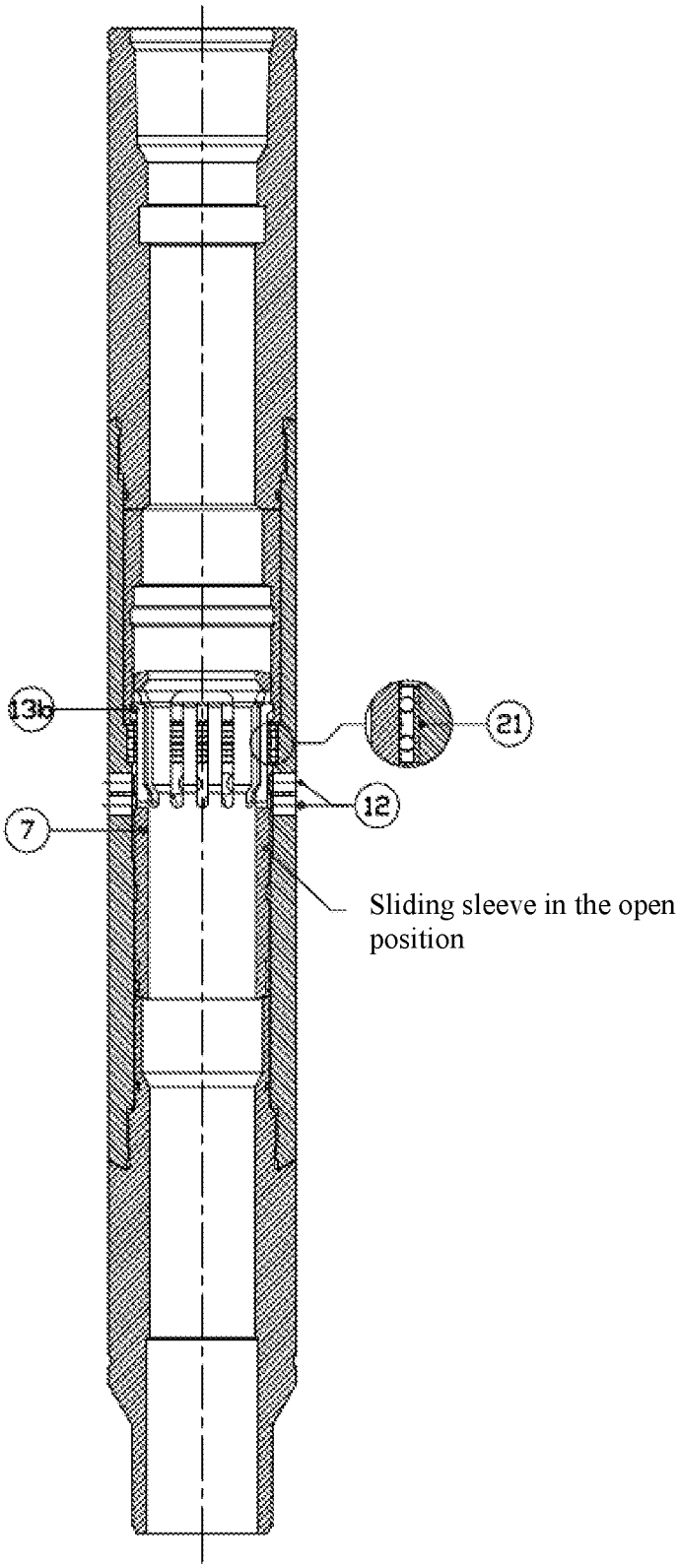
FIG. 2B is a longitudinal axial section view of the circulation casing [FIG. 1(4)] and the location of the sliding sleeve in the inverted [FIG. 2B(7)] open position, where the latch hooks [FIG. 3(15)] are locked in the lower safety housing [FIG. 2B(13*b*)]. The following elements are also specified: the peripheral circulation windows [FIG. 2B(12)]; and the set of seals [FIG. 2B(21)].
Figure 3:
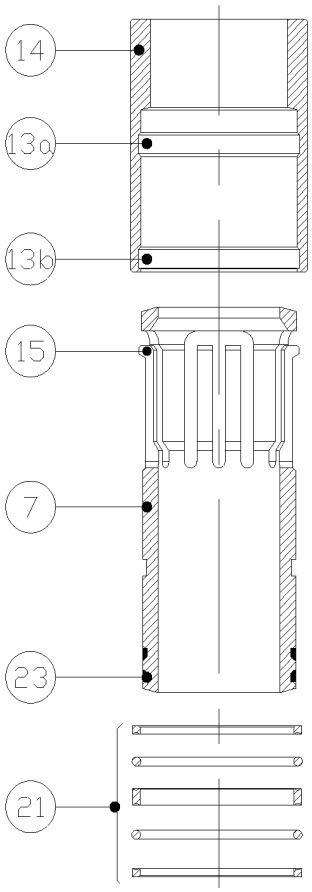
FIG. 3 represents a detailed view of the development of the internal components of the circulation casing [FIG. 1(4)]. The following parts are specified: the set of seals [FIG. 3(21)]; the seal retaining sleeve [FIG. 3(14)] including the safety housings [FIG. 3(13*a*)] and [FIG. 3(13*b*)]; and the sliding sleeve [FIG. 3(7)], including the circumferential latch hooks [FIG. 3(15)] and the sealant "O" rings [FIG. 3(23)].

FIG. 2B provides a longitudinal axial section view of the circulation casing with the sliding sleeve in the open (downward) position; in this case, the fluid may be in contact through the peripheral circulation windows of the sliding sleeve [FIG. 2B(7)] and flow through the peripheral circulation windows of the housing of the casing [FIG. 2B(12)] towards the annular space [FIG. 1(2)]; in this position, it is observed that the circumferential latch hooks [FIG. 3(15)] are locked in the safety housing [FIG. 2B(13*b*)].

Figure 2C:
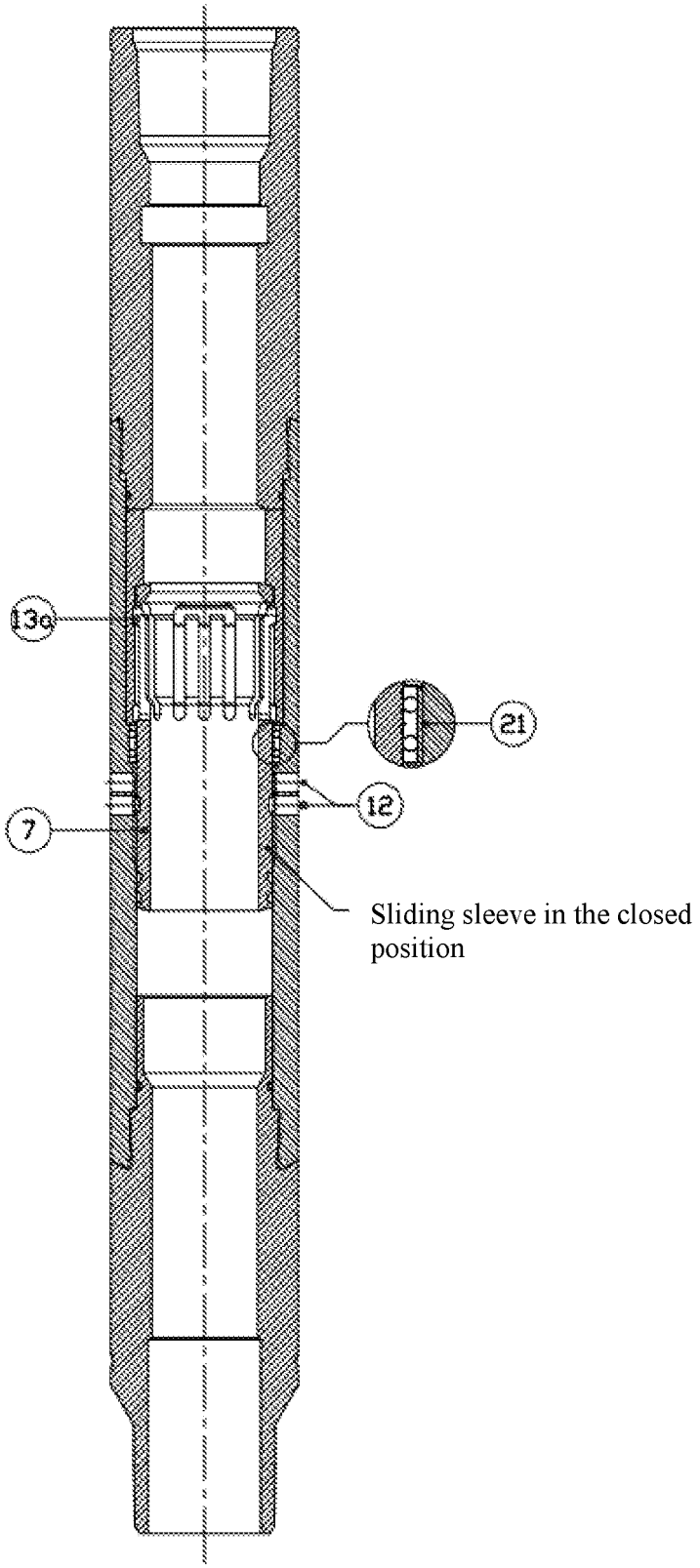
FIG. 2C is a longitudinal axial section view of the circulation casing [FIG. 1(4)] and the location of the sliding sleeve in the inverted [FIG. 2C(7)] closed position, where the latch hooks [FIG. 3(15)] are locked in the upper safety housing [FIG. 2C(13*a*)]. The following elements are also specified: the peripheral circulation windows [FIG. 2C(12)] and the set of seals [FIG. 2C(21)].

FIG. 2C shows a longitudinal axial section view of the circulation casing with the sliding sleeve [FIG. 2C(7)] in the closed (upwards) position; in this case, the peripheral circulation windows [FIG. 2C(12)] are not connected to the peripheral windows of the casing, and thus the fluid cannot reach the annular space of the coating pipe; in this position, it is observed that the circumferential latch hooks [FIG. 3(15)] of the sliding sleeve [FIG. 2C(7)] are locked in the safety housing [FIG. 2C(13*a*)].

FIG. 3 represents a cross-sectional view of the development of the internal components of the circulation casing of this invention, showing below the set of seals [FIG. 3(21)] that are housed in the interior of the tubular cylindrical housing [FIG. 2A(8)]. In the upper part, it can be observed the seal retaining sleeve [FIG. 3(14)], which is a metallic cylindrical element that fasten the set of seals [FIG. 3(21)] within the tubular cylindrical housing [FIG. 2A(8)]; in its inner part, it has the safety housings [FIG. 3(13*a*)] and [FIG. 3(13*b*)] houses the circumferential latch hooks [FIG. 3(15)] of the sliding sleeve [FIG. 3(7)]; the seal retaining sleeve [FIG. 3(14)] is maintained affixed by the lower connector [FIG. 2A(11)] of the circulation casing. Finally, between the set of seals and the seal retaining sleeve, it can be observed the sliding sleeve [FIG. 3(7)], the upper part of which has the circumferential latch hooks [FIG. 3(15)] that act as a lock when they enter the safety housings [FIG. 3(13*a*)] and [FIG. 3(13*b*)]. These safety housings are located in the internal part of the seal retaining sleeve [FIG. 3(14)]. The sliding sleeve [FIG. 2A(7)], with its downward or upward axial movement, enables the opening and closing, respectively, of the passage of fluids through the peripheral circulation windows [FIG. 2A(12)] of the tubular cylindrical housing [FIG. 2A(8)]. In the lower part of the sliding sleeve [FIG. 3(7)], there are two tangential channels that house two sealant rings [FIG. 3(23)] that form a seal with the tubular cylindrical housing [FIG. 2A(8)].

With this new design of the casing for the circulation of fluids at the bottom of oil wells of the invention, the risk that the casing closes as the jet pump enters is prevented.

The sliding sleeve [FIG. 2A(7)] of the circulation casing [FIG. 1(4)] is driven by impact, for which it is necessary to move the sliding tool through the inner part of the production pipe, from the surface, with the help of a steel wire rope; this tool enters the circulation casing and, after hooking itself, starts hitting upward to close the circulation casing and downward to open it.

As a result of this invention, important advantages are obtained over the prior art, since the fact of inverting the closing system of the casing provides more safety in the operations of assessment and production of the wells with the jet pump system. Moreover, by increasing the outer diameter of the circulation casing in all its parts throughout the casing and redesigning the system of threaded connections of the housing, a greater duration of it at the bottom of the well is ensured.

The invention claimed is:

1. A casing for circulation of fluids at a bottom of an oil well, comprising:

a tubular cylindrical housing with a series of peripheral circulation windows;

a set of sealant rings housed inside the tubular cylindrical housing;

a seal retaining sleeve, which, in its inner part, has safety housings which are configured to house a plurality of latch hooks;

a sliding sleeve, whose structure at its upper end is formed by the plurality of latch hooks arranged axially and circumferentially, the sliding sleeve is positioned by attaching the latch hooks to one of the safety housings of the seal retaining sleeve, wherein when the sliding sleeve moves downward to a position in which the peripheral circulation windows are aligned with spaces between lower sections of the latch hooks of the sliding sleeve, the sliding sleeve carries out an opening operation of the casing for the circulation of fluids, allowing passage of production fluids.

2. The casing for circulation of fluids at a bottom of the oil well, according to claim 1, wherein the latch hooks at the upper end of the sliding sleeve located within the tubular cylindrical housing act as a lock when the latch hooks enter one of the safety housings on the inner part of the seal retaining sleeve and are hooked.

3. The casing for circulation of fluids at a bottom of the oil well of claim 1, wherein the sliding sleeve located within the tubular cylindrical housing, lacks vulcanized seals.

4. The casing for circulation of fluids at a bottom of the oil well of claim 1, wherein an outer diameter of a body of the casing for the circulation of fluids has been increased by 1.27 cm (500 thousandths of an inch) to guarantee greater tensile strength, compression and stress management resulting from the impact actions of the opening and closing operations of the circulation casing.

* * * * *